US006626198B2

(12) United States Patent
Tseng

(10) Patent No.: US 6,626,198 B2
(45) Date of Patent: Sep. 30, 2003

(54) RESILIENT STAVE SUPPORT ASSEMBLY FOR UMBRELLA

(76) Inventor: Cheng Yuan Tseng, 11F, No. 82, Lane 99, Sec. 2, Fu Hsin Road, Taichung (TW), 402

( * ) Notice: Subject to any disclaimer, the term of this patent is extended or adjusted under 35 U.S.C. 154(b) by 13 days.

(21) Appl. No.: 09/828,517

(22) Filed: Apr. 9, 2001

(65) Prior Publication Data

US 2002/0144722 A1 Oct. 10, 2002

(51) Int. Cl.[7] ..... A45B 19/10

(52) U.S. Cl. ..... 135/25.32; 135/20.3; 135/22; 135/25.33; 135/25.34; 135/25.4; 135/39; 135/40; 135/908

(58) Field of Search ..... 135/15.1, 20.3, 135/22, 24, 25.1, 25.3, 25.33, 25.34, 28, 29, 39, 40, 908

(56) References Cited

U.S. PATENT DOCUMENTS 3,837,352 A * 9/1974 Weber ..... 135/25 R
3,856,031 A * 12/1974 Weber ..... 135/25 R
4,077,420 A * 3/1978 Schultes et al. ..... 135/25 R
4,077,421 A * 3/1978 Schultes et al. ..... 135/25 R
4,105,039 A * 8/1978 Schultes et al. ..... 135/25 A
5,144,971 A * 9/1992 Seidel et al. ..... 135/22
5,494,065 A * 2/1996 Kuo et al. ..... 135/31
5,564,449 A * 10/1996 Lin et al. ..... 135/24
6,230,725 B1 * 5/2001 Ko ..... 135/31

* cited by examiner

*Primary Examiner*—Carl D. Friedman
*Assistant Examiner*—Yvonne M. Horton
(74) *Attorney, Agent, or Firm*—Charles E. Baxley

(57) ABSTRACT

An umbrella a fixed ring secured on top of a rod, a middle ring and a lower ring slidably engaged on the rod, a number of main staves having inner ends rotatably securing to the middle ring, a number of upper staves pivotally coupled between the fixed ring and the main staves, and a number of stave supports each having an inner end rotatably coupled to the lower ring and an outer end secured to the middle portion of the main staves. The main staves and the stave supports are made of composite materials for increasing the strength and for reducing the weight of the umbrella.

8 Claims, 5 Drawing Sheets

RESILIENT STAVE SUPPORT ASSEMBLY FOR UMBRELLA

BACKGROUND OF THE INVENTION

1. Field of the Invention

The present invention relates to an umbrella, and more particularly to an umbrella having an improved resilient stave support assembly.

2. Description of the Prior Art

Typical umbrella devices comprise a foldable whale bone including two or more sections that may be folded to a short and compact configuration. For example, as shown in FIG. 1, illustrated is a typical umbrella including a ring 11 secured on top of a handle or a rod 10, and two further rings 20, 30 slidably engaged on the rod 10 and movable along the rods 10 for opening or folding the whale bones. One or more springs 40 are engaged on the rod 10 and engaged with the rings 11, 20, 30 for applying a resilient or biasing force against the rings 11, 20, 30.

The whale bones of the umbrella includes a number of main staves 91 each having an inner end rotatably or pivotally secured to the ring 20 and each having an outer end, a number of stave supports 92 each having an inner end rotatably or pivotally secured to the ring 30 and each having an outer end rotatably or pivotally secured to the inner portion of the main stave 91 with a pivot pin or a bracket 93. A number of upper staves 95 each having an inner end rotatably or pivotally secured to the ring 11 and each having an outer end rotatably or pivotally secured to the middle portion of the main stave 91 with a pivot pin or a bracket 94. A number of outer staves 98 each includes an inner end rotatably or pivotally secured to the outer end of the main stave 91 with a bracket 96, and a number of intermediate staves 97 each includes an inner end rotatably or pivotally secured to the outer portion of the upper stave 95 and each includes an outer end rotatably or pivotally secured to the inner portion of the outer stave 98 or pivotally coupled to the bracket 96.

However, the whale bone device includes a number of stave members 91, 95, 97, 98 and a number of stave supports 92 that are made of metal materials, such that the whale bone device includes a great weight that is adverse for transportation purposes and that is not good for being held and operated by the children or the old people.

The present invention has arisen to mitigate and/or obviate the afore-described disadvantages of the conventional umbrella devices.

SUMMARY OF THE INVENTION

The primary objective of the present invention is to provide an umbrella having an improved resilient stave support assembly for facilitating the operation of the umbrella.

The other objective of the present invention is to provide an umbrella having a whale bone device made of composite materials or fiber reinforcing materials for increasing the strength of the whale bone device and for reducing the weight of the whale bone device.

In accordance with one aspect of the invention, there is provided an umbrella comprising a rod, a first ring secured on top of the rod, a second ring and a third ring slidably engaged on the rod, a plurality of main staves each including an inner end rotatably securing to the second ring and each including a middle portion, a plurality of upper staves pivotally coupled between the first ring and the main staves, and a plurality of stave supports each including an inner end rotatably coupled to the third ring and each including an outer end solidly secured to the middle portion of the main staves.

The main staves and the stave supports are made of composite materials. The stave supports each includes a barrel provided on the outer end thereof and secured to the main staves respectively. The stave supports each includes a coupling member provided between the stave supports and the barrels thereof respectively.

The third ring includes a plurality of grooves formed therein, the inner ends of the stave supports each includes a head provided thereon and rotatably engaged in the grooves of the third ring respectively. The heads of the stave supports are preferably made of composite materials.

The inner ends of the main staves each includes a coupler provided thereon and made of composite materials. The upper staves each includes an outer end, the main staves each includes a bracket provided thereon and made of composite materials and pivotally secured to the outer ends of the upper staves respectively.

The outer ends of the main staves each includes a coupler provided thereon and made of composite materials, the umbrella further includes a plurality of outer staves each having an inner end and each having a bracket provided on the inner end thereof and rotatably secured to the outer ends of the upper staves respectively, and includes a plurality of intermediate staves pivotally coupled between the upper staves and the brackets of the outer staves respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
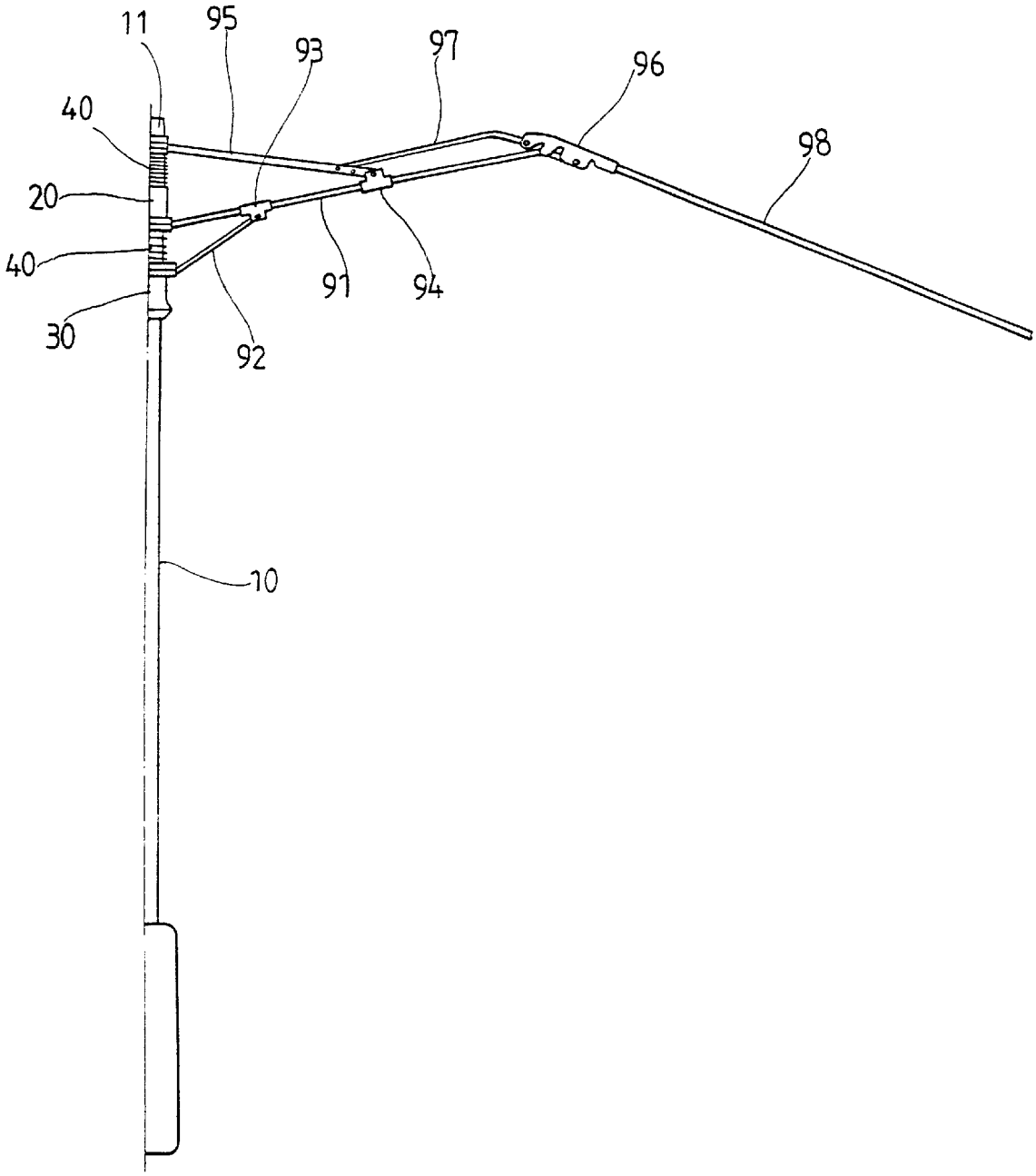
FIG. 1 PRIOR ART
FIG. 1 is a partial plane view showing a typical umbrella.
Figure 2:
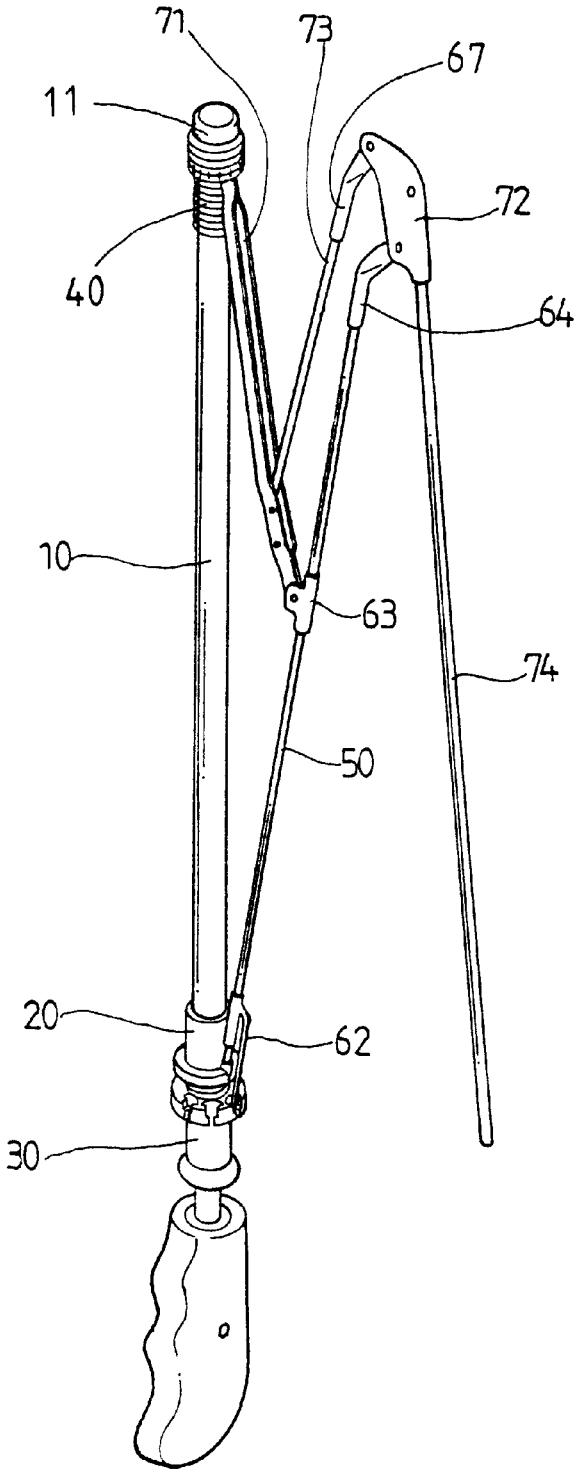
FIG. 2 is a perspective view of an umbrella in accordance with the present invention.
Figure 3:
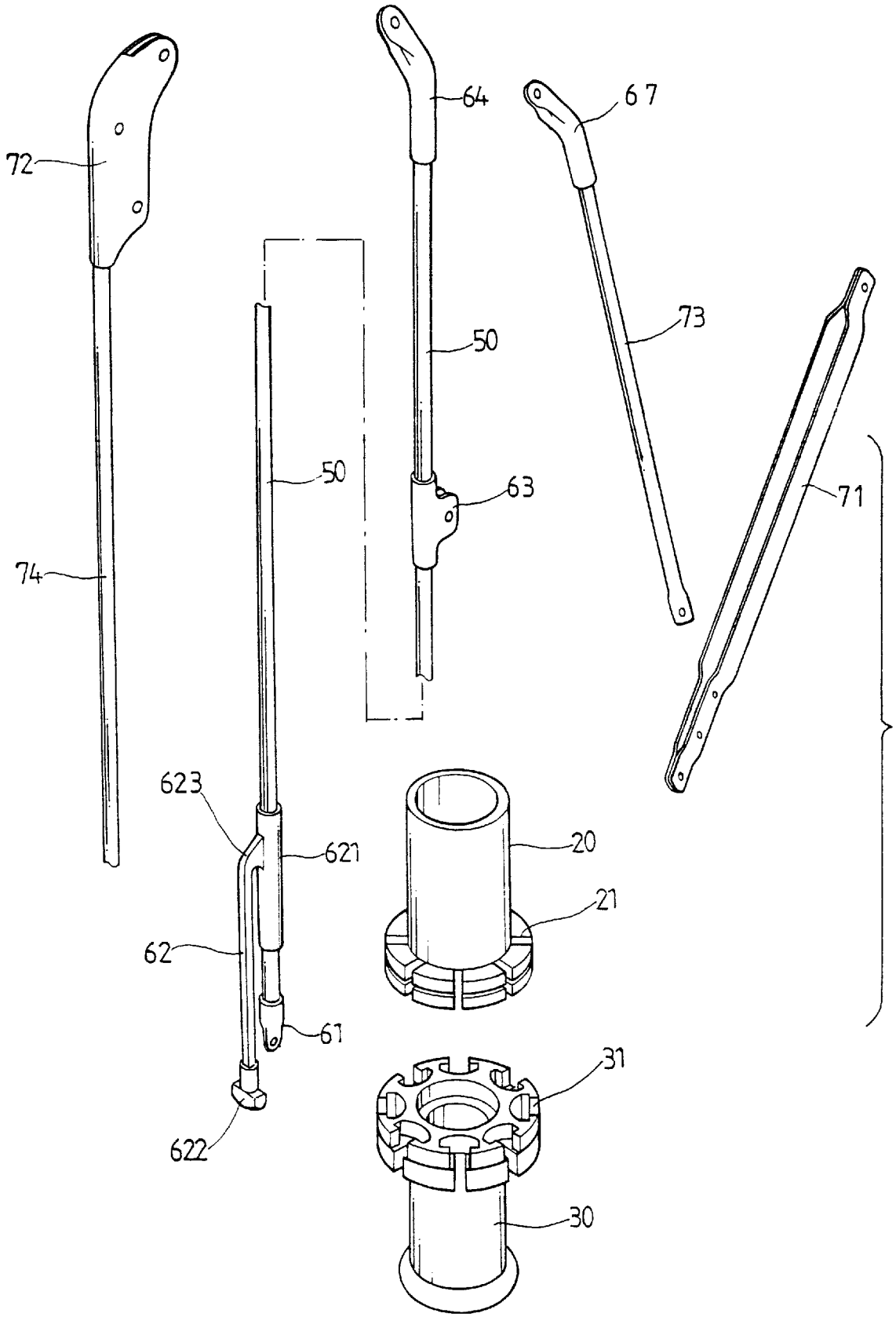
FIG. 3 is a partial exploded view of the umbrella.
Figure 4:
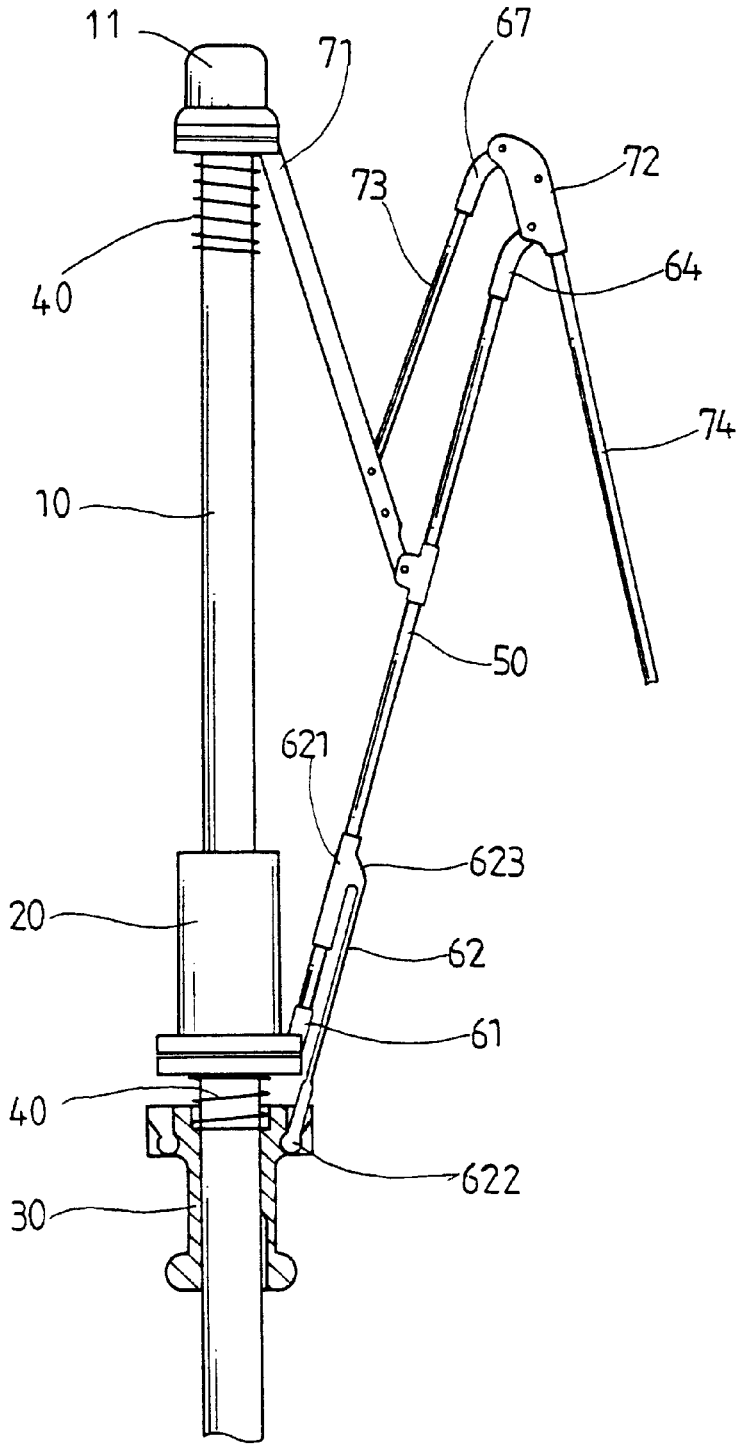
FIG. 4 is a partial plane view of the umbrella, in which a portion of the umbrella has been cut off for showing the inner structure of the umbrella.

Referring to the drawings, and initially to FIGS. 2–4, an umbrella in accordance with the present invention comprises a ring 11 secured on top of a handle or a rod 10, and two further rings 20, 30 slidably engaged on the rod 10 and movable along the rods 10 for opening or folding the whale bones. One or more springs 40 are engaged on the rod 10 and engaged with the rings 11, 20, 30 for applying a resilient or biasing force against the rings 11, 20, 30. The rings 11, 20 each includes a number of slots 21 formed therein for rotatably or pivotally securing the whale bone members. The ring 30 also includes a number of grooves 31 formed therein for rotatably or pivotally securing the whale bone members.

The whale bone of the umbrella includes a number of main staves 50 each having an inner end rotatably or pivotally secured to the ring 20, a number of upper staves 71 each having an inner end rotatably or pivotally secured to the ring 11 and each having an outer end rotatably or pivotally secured to the middle or the outer portion of the main stave 50 with a pivot pin or a bracket 63, a number of outer staves 74 each having an inner end rotatably or pivotally secured to the outer end of the main stave 50 with a bracket 72, and a number of intermediate staves 73 each having an inner end rotatably or pivotally secured to the outer portion of the upper stave 71 and each includes an outer end rotatably or pivotally secured to the inner portion of the outer stave 74 or pivotally coupled to the bracket 72. The above described whale bone structure of the umbrella is typical and will not be described in further details.

The umbrella in accordance with the present invention further includes a number of stave supports 62 each having a head 622 provided and formed in the inner end thereof for rotatably or pivotally securing in the grooves 31 of the ring 30 and each having a barrel 621 provided or formed on the inner or the middle portion of the main stave 50 and each having an enlarged coupling portions or coupling members 623 formed between the stave support 62 and the barrel 621 for reinforcing the stave support 62.

The main stave 50 is preferably made of plastic materials, fiber reinforcing materials, composite materials, or the like, which has an increased strength and a reduced weight than that of the typical metal whale bone devices. The main stave 50 includes an inner end and/or an outer end having a coupler 61, 64 provided or formed or molded thereon by such as the molding process, with the plastic materials, fiber reinforcing materials, composite materials, or the like. The stave support 62 and/or the bracket 63 may also be made of plastic materials, fiber reinforcing materials, composite materials, or the like, such that the strength of the whale bone device may be increased and such that the weight of the whale bone device may be reduced, as compared with that of the typical metal whale bone devices.

It is to be noted that the bracket 72 may also be made of plastic materials, fiber reinforcing materials, composite materials, or the like, and may also be formed or molded on the outer stave 74 by such as the molding process. The intermediate stave 73 may include a coupler 67 provided or formed or molded on the outer end thereof with such as the molding process, and made of plastic materials, fiber reinforcing materials, composite materials, or the like.

Figure 5:
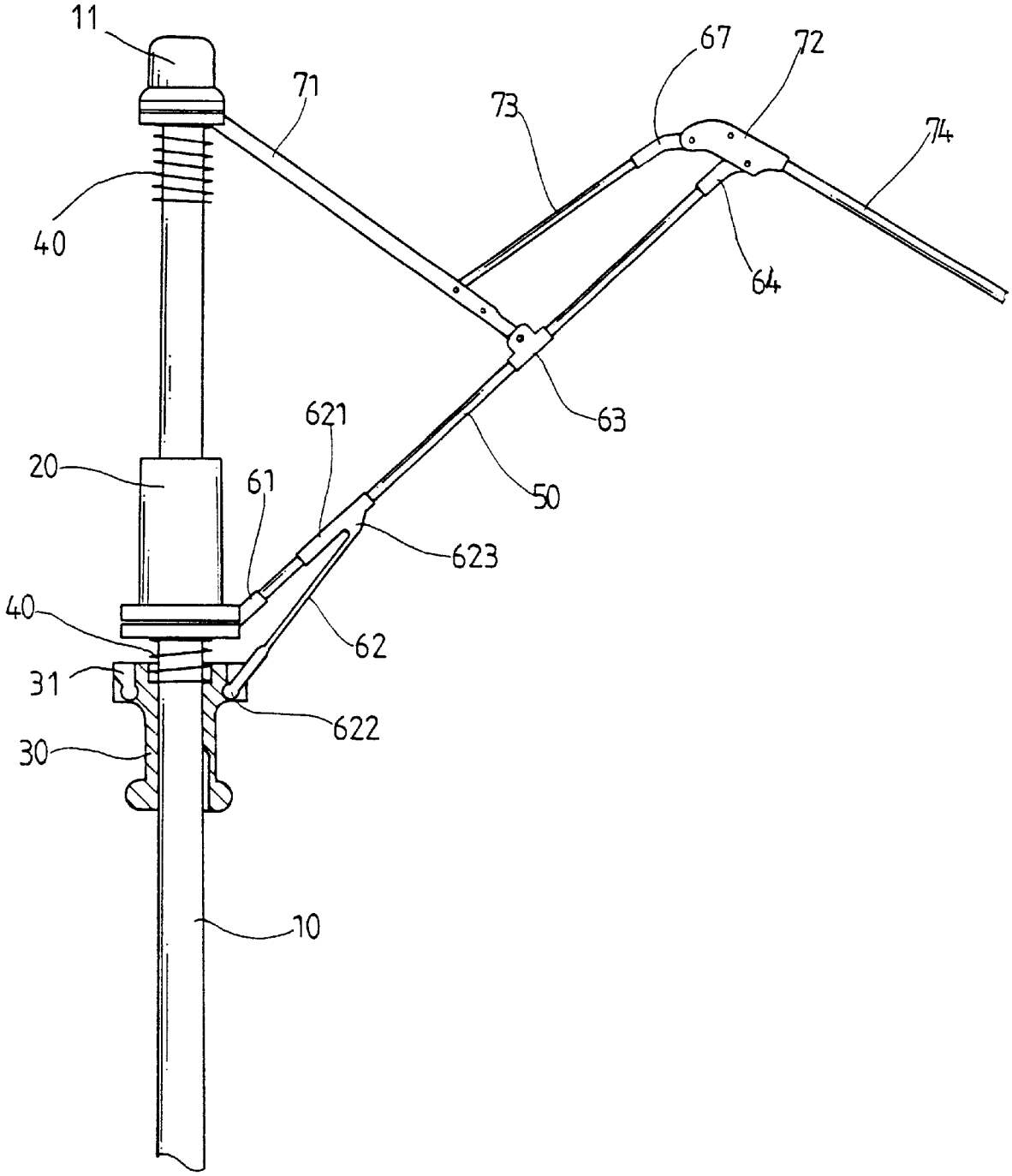
FIG. 5 is a partial plane view of the umbrella, similar to FIG. 4, in which a portion of the umbrella has been cut off for showing the inner structure of the umbrella, for illustrating the operation of the umbrella.

It is further to be noted that the stave support 62 made of plastic materials, fiber reinforcing materials, composite materials, or the like, includes a suitable resilience for allowing the stave support 62 to be sprung or moved toward or away from the main stave 50 (FIGS. 4, 5). The enlarged coupling portions or coupling members 623 of the stave support 62 may be used for reinforcing the stave support 62 and for preventing the stave support 62 from being broken relative to the barrel 621.

Accordingly, the umbrella in accordance with the present invention includes an improved resilient stave support assembly for facilitating the operation of the umbrella, and includes a whale bone device made of composite materials or fiber reinforcing materials for increasing the strength of the whale bone device and for reducing the weight of the whale bone device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella comprising:

a rod, a first ring secured on top of said rod, a second ring and a third ring slidably engaged on said rod, a plurality of main staves each including an inner end rotatably securing to said second ring and each including a middle portion, a plurality of upper staves pivotally coupled between said first ring and said main staves, and a plurality of stave supports each including an inner end rotatably coupled to said third ring and each including an outer end secured to said middle portion of said main staves, and said stave supports each including a barrel provided on said outer end thereof and secured to said main staves respectively.

2. The umbrella according to claim 1, wherein said main staves and said stave supports are made of composite materials.

3. The umbrella according to claim 1, wherein said stave supports each includes a reinforcing coupling member provided between said stave supports and said barrels thereof respectively for reinforcing said stave supports.

4. The umbrella according to claim 1, wherein said third ring includes a plurality of grooves formed therein, said inner ends of said stave supports each includes a head provided thereon and rotatably engaged is said grooves of said third ring respectively.

5. The umbrella according to claim 4, wherein said heads of said stave supports are made of composite materials.

6. The umbrella according to claim 1, wherein said inner ends of said main staves each includes a coupler provided thereon and made of composite materials.

7. The umbrella according to claim 1, wherein said upper staves each includes an outer end, said main staves each includes a bracket provided thereon and made of composite materials and pivotally secured to said outer ends of said upper staves respectively.

8. An umbrella comprising:

a rod, a first ring secured on top of said rod, a second ring and a third ring-slidably engaged on said rod, a plurality of main staves each including an inner end rotatably securing to said second ring and each including a middle portion and an outer end, said outer ends of said main staves each including a coupler provided thereon and made of composite materials, a plurality of upper states pivotally coupled between said first ring and said main staves, a plurality of stave supports each including an inner end rotatably coupled to said third ring and each including an outer end secured to said middle portion of said main staves, a plurality of outer states each having an inner end and each having a bracket provided on said inner end thereof and rotatably secured to said outer ends of said main staves respectively, and a plurality of intermediate staves pivotally coupled between said upper staves and said brackets of said outer staves respectively.

* * * * *